US005424114A

United States Patent [19]

Groshens

[11] Patent Number: 5,424,114

[45] Date of Patent: Jun. 13, 1995

[54] TEXTILE FOR STIFFENING AND METHOD OF MANUFACTURING SAME

[75] Inventor: Pierre Groshens, Peronne, France

[73] Assignee: Lainiere de Picardie, Peronne, France

[21] Appl. No.: 194,637

[22] Filed: Feb. 10, 1994

Related U.S. Application Data

[63] Continuation of Ser. No. 931,556, Aug. 18, 1992, abandoned, which is a continuation of Ser. No. 541,896, Jun. 22, 1990, abandoned.

[30] Foreign Application Priority Data

Jun. 29, 1989 [FR] France ..... 89 082723

[51] Int. Cl.[6] ..... B32B 7/00; B32B 7/04

[52] U.S. Cl. ..... 428/196; 428/197; 428/198; 428/212; 428/219; 428/236; 428/245; 428/253; 428/261; 428/287; 428/288

[58] Field of Search ..... 60/169, 190, 191, 202; 428/233, 196, 197, 198, 212, 219, 236, 245, 253, 261, 287, 288

[56] References Cited

U.S. PATENT DOCUMENTS

| | | | |
|---|---|---|---|
| 2,330,814 | 10/1943 | Drew | 162/108 |
| 3,129,466 | 4/1964 | L'Hommedieu | 162/108 |
| 3,808,088 | 4/1974 | Knechtges et al. | 161/148 |
| 3,808,088 | 4/1974 | Knechtges et al. | 161/148 |
| 4,696,850 | 9/1987 | Jost et al. | 428/197 |
| 4,696,850 | 9/1987 | Jost et al. | 428/197 |
| 4,704,757 | 11/1987 | Young | 13/104.94 |
| 5,294,479 | 3/1994 | Longo | 428/236 |

FOREIGN PATENT DOCUMENTS

| | | |
|---|---|---|
| 526940 | 3/1954 | Belgium . |
| 0331215 | 9/1989 | European Pat. Off. . |
| 2001893 | 10/1969 | France . |
| 2157880 | 6/1973 | France . |

*Primary Examiner*—Patrick J. Ryan
*Assistant Examiner*—Richard C. Weisberger
*Attorney, Agent, or Firm*—Popham, Haik, Schnobrich & Kaufman, Ltd.

[57] ABSTRACT

The invention relates to a textile for stiffening. It comprises two textile layers (1, 2).

According to the invention, the textile layers (1, 2) are bonded together by a hot-sprayed adhesive formed of cross-linkable polymers.

4 Claims, 1 Drawing Sheet

TEXTILE FOR STIFFENING AND METHOD OF MANUFACTURING SAME

This application is a continuation of U.S. patent application Ser. No. 07/931.556, filed Aug. 18, 1992, which is a continuation of U.S. patent application Ser. No. 07/541,896, filed Jun. 22, 1990, both abandoned.

The invention relates to a textile intended for stiffening and the method of manufacturing same.

It relates more particularly to textiles for stiffening the fronts of clothes, shirt and blouse collars, shirt fronts, co-shirt fronts, shirt front stiffenings or shirt-front covers.

These products are intended to give to the textiles or draperies on which they are fixed and to the clothes the feel, the flexibility, the toughness which they do not have by themselves.

Textiles for stiffening are already known incorporating a non-woven textile layer. For example, according to the patent FR-A-2 223 496, it is proposed to form a cloth comprising at least one layer of non-woven and non oriented fibers and at least one additional layer having a high degree of orientation. These layers are sewn together by synthetic threads and coating thereof so as to obtain a heat bonding product is envisaged.

Furthermore, the technique of hot spraying an adhesive formed of cross-linkable polymers is known. This hot melt technique makes it possible to obtain bonding by textile fusion.

The purpose of the present invention is to provide a textile for stiffening formed of several textile layers, the properties of the complex being determined by the choice of the properties of each of the layers.

Another object is to provide a new product comprising two knitted, woven or non-woven textile layers whose manufacture may be reliable, relatively simple and inexpensive.

For this, the invention relates to a stiffening textile of the type comprising two knitted, woven or non-woven textile layers. According to the invention, the non-woven textile layer or layers are fastened together by a hot sprayed adhesive formed of cross-linkable polymers.

The invention will be described in detail with reference to the accompanying drawings in which.

Figure 1:
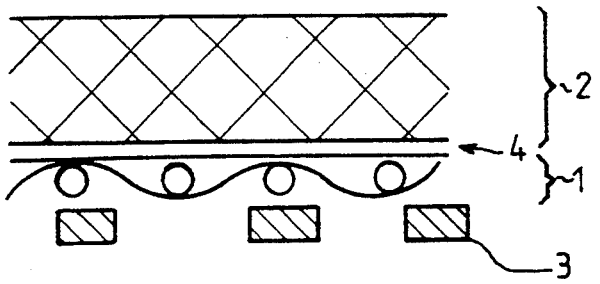
FIG. 1 is a sectional view of the stiffening textile of the invention.
Figure 2:
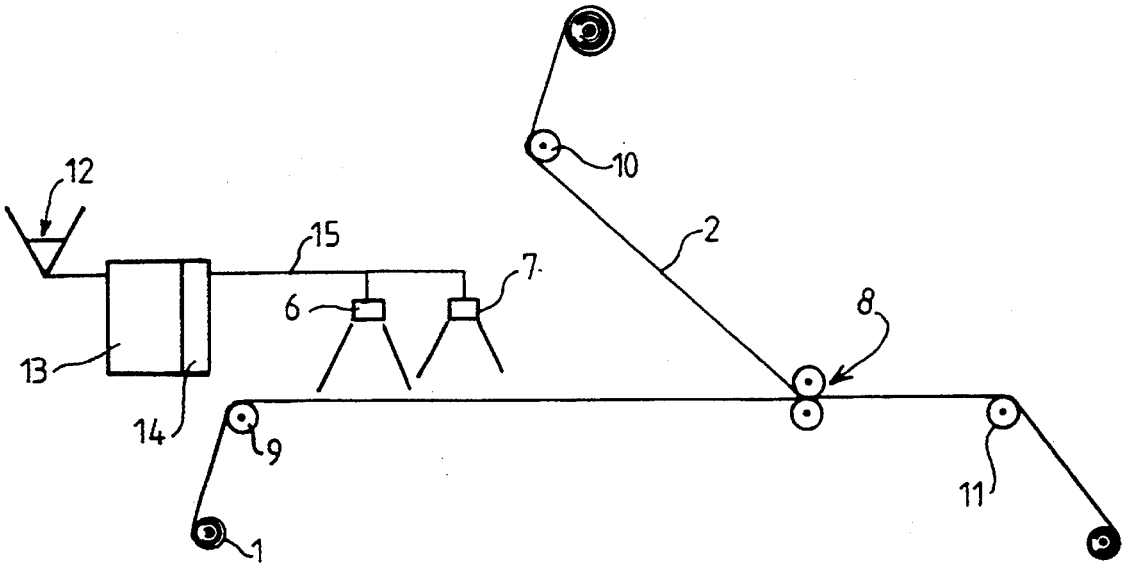
FIG. 2 is a schematic representation of the manufacture of the textile of the invention.

The stiffening textile comprises two textile layers 1, 2. It may possibly comprise a thermoadhesive coating layer 3.

In the preferred embodiment, the first textile layer 1 is knitted or woven. It forms a textile support. The second layer 2 is a non-woven layer.

The textile support 1 is of the same type as the fabrics usually used in the stiffening field. It may be formed with synthetic fibers, polyester or polyamide fibers or else natural or artificial fibers.

This support is woven or preferably knitted. It may then comprise a weft. The compactness and numbering of the threads which form it are adapted so as to give it the qualities of toughness, flexibility, elasticity, strength which contribute to the properties of the stiffening textile which incorporates them.

The non-woven layer or layers 2 are formed of synthetic, artificial, natural fibers which are carded and oriented or not, chosen as a function of the volume and feel of the textile complex it is desired to obtain. The numbering of the fibers may vary from 0.3 decitex for producing light stiffenings to 10 to 15 decitex for heavy stiffenings, for example intended for shirt fronts.

The non-woven layer or layers 2 may be obtained by direct spinning "spun" or by "melt blown". This layer may be partially needled, it may also undergo heat bonding or any other form of bonding.

The non-woven layer or layers 2 are fixed to the knitted or woven textile support 1 by a hot sprayed adhesive formed of cross-linkable polymers.

In themselves, numerous adhesives formed of cross-linkable polymers are known in the textile field as being able to be hot sprayed. In particular, they may be polyurethanes, polyamides or polyesters. Preferably, polymers will be used whose cross-linking takes place in contact with the ambient medium, for example under the effect of humidity.

Thus sprayed, the adhesive forms a thin layer which has great flexibility and so does not affect the flexibility and feel of the composite textile intended for the stiffening which incorporates it. In addition, this adhesive layer does not form a gas barrier. It is thus possible to form a textile for stiffening which can breathe, using a textile support and a non-woven layer whose properties confer this property on the textile complex which incorporates them.

Such association for forming the textile for stiffening two textiles each having specific properties makes it possible to obtain a great variety of textile complexes and to control the properties thereof. The textile support gives to the complex its mechanical qualities and the non-woven layer gives it its volume and its feel. Thus the resilience and flexibility of the complex can be determined.

A very open textile support will preferably be used which may be a woven fabric.

The association of two textile layers by means of a hot sprayed adhesive makes it possible to obtain a stiffening which forms an efficient barrier preventing flow of the polymers through the complex which leads to bleed-through. This type of association maintains a uniform distribution of the fibers of the non-woven fabric. On the contrary, when a non-woven layer is associated by sewing with a second layer, the stitches cause regrouping of the fibers which make the stiffening fragile and may cause bleed-through.

In another embodiment, the two layers of the complex are woven or knitted. A knitted fabric may for example be stiffened by a textile grid. The knitted fabric mainly provides the volume and feel of the stiffening and the grid contributes mainly to its flexibility and resilience.

During manufacture of the textile for stiffening, the first layer 1 is fed by a roll 9 in contact with the second layer 2 guided by roll 10. The roll-counter roll assembly 8 places the two layers 1, 2 in contact.

Before such contacting, the first layer 1 is coated with an adhesive formed of cross-linkable polymers hot sprayed by injectors 6, 7. The polymers 12 are introduced into oven 13 where they are brought to their melting temperature and they are then fed under pressure by pump 14 via ducts 15 towards the injectors 6 and 7.

The polymers 12 cross-linking in the ambient medium secure the non-woven layer 2 to the textile support 1.

After guiding by roll 11, the stiffening textile thus formed is wound for storage.

Surprisingly, hot spraying of polymers although producing a thin adhesive layer provides good securing of the two textile layers, capable of withstanding all the treatments to which stiffening textiles are usually subjected. I particular, they withstand washing, dry cleaning, ironing, . . .

During spray coating, the textile support is placed in contact with the molten adhesive but is not brought to a higher temperature and is only subjected to this temperature for a short time. For this reason, it is possible to use a relatively fragile textile support which would likely be damaged by other coating methods and it is even possible to use a textile Support which is already coated on its other face with a thermoadhesive layer. Such a layer is intended for bonding the stiffening to drapery or a lining. By using the above described technique, the thermoadhesive layer remains at a temperature less than the temperature to which it is brought during bonding and its properties are therefore not affected.

The following compositions are given by way of examples and other embodiments are possible within the scope of the invention. The different adhesives mentioned above may be used for forming the composite textile of the invention or implementing the method.

EXAMPLE 1

First layer: woven layer of a weight of about 200 g/m$^2$ comprising a cotton warp with a density of 2400 threads per meter, formed of threads numbering 20 Tex and a weft with a density of 1400 threads per meter, formed of a mixture of animal fibers (goat hairs, linen, horsehair) and cellulose fibers.

Second layer: non-woven layer formed of synthetic fibers numbering about 3 decitex. This layer has a weight of about 100 g/m$^2$, it is previously needled heat bonded or reinforced by a knitted fabric.

The textile thus obtained is very tough in the weft direction and has good resilience. Its volume and feel are essentially provided by the non-woven layer. This textile is more particularly intended for shirt fronts.

EXAMPLE 2

First layer: warp knitted fabric with weft insertion, of a weight of about 60 g/m$^2$. The knitted fabric is of warp type, with continuous multifilament synthetic threads having a density of about 600 to 1200 columns per meter and numbering from 20 to 50 decitex. The weft is formed with synthetic, artificial or natural fibers. The density of the weft threads is about 900 to 1300 threads per meter, their numbering is about 30 to 70 decitex.

Second layer: non-woven layer having a weight of about 25 g/m$^2$ formed of heat bonded synthetic fibers, a layer of fibers obtained by the melt blown technique or chemically bonded cellulose fibers.

The textile thus obtained is dimensionally stable, it is non-crease and has good volume. It is particularly well adapted to the formation of heat bonded stiffenings. In this application, it may be coated with a discontinuous thermoadhesive layer, deposited either on the face of the non-woven layer or on the side of the woven warp knitted fabric. This textile then avoids the drawbacks resulting from the flowing of polymers from the thermoadhesive layer through their support.

EXAMPLE 3

First layer: fabric having a weight of about 70 g/m$^2$ formed . either of a woven fabric formed of cellulose threads, or a mixture of synthetic, animal or artificial threads; the numbering of the threads is about 30 Tex, their density is approximately from 1400 to 2000 threads per meter; . or a warp knitted fabric incorporating a long weft and having a layer of straight threads in the warp direction.

The fabric is then formed with multifilament synthetic threads numbering from 20 to 50 decitex with a density of about 900 columns per meter.

The long weft is formed of synthetic, artificial or cellulose threads or a mixture of such threads, numbering from 20 to 50 decitex and with a density of about 1200 columns per meter.

The layer of straight warp threads (capstan) is formed of synthetic, artificial or cellulose threads or a mixture of such threads, numbering about 25 Tex and having a density of about 900 threads to the meter.

Second layer: depending on the properties sought, it is formed of:

a non-woven layer fabric of synthetic heat bonded fibers of a weight of about 50 g/m$^2$;

a non-woven fabric of artificial needled fibers of a weight of about 20 g/m$^2$;

a non-woven fabric reinforced by a knitted fabric;

a woven mesh textile similar to that used for the first layer;

a woven fabric similar to that used for the first layer.

The textile thus obtained is stable and non-crease. It has a volume and a resilience which, when it used for manufacturing shirt fronts, avoids the use of a loose shirt front.

It is therefore well adapted to the formation of thermoadhesive stiffenings comprising reinforced zones.

It is also possible in accordance with the invention to associate a textile layer and one or more non-woven layers of different widths. Thus a textile is obtained for stiffening whose properties of flexibility, feel, . . . are variable in the warp direction. These same properties may also be varied in the weft direction by associating a second textile layer with a first one in certain zones only thereof. In this case, the two textile layers 1 and 2 have the same width, the second layer is coated by hot spraying and cut into strips as it advances.

The first textile layer which advances continuously is associated as described above with a strip of the second textile layer whose advance is then stopped. After a given advance of the first layer without association with the second, the association is again caused. Thus, a complex is obtained comprising alternately one or two textile layers and therefore having properties which are variable in the weft direction which is particular appreciated for forming shirt fronts and for multizone front stiffenings.

I claim:

1. A textile, comprising:

two textile layers bonded together by a continuous adhesive layer separating the two textile layers; wherein:

a) the continuous adhesive layer is made of at least one cross-linkable polymer; and b) the textile is obtained by a process of:

1) hot spraying the polymer as the continuous adhesive layer onto one of the textile layers; immediately before a further step of:

2) laminating the two textile layers together, via the continuous adhesive layer, so that the cross-linkable polymer in the continuous adhesive layer substantially prevents bleed-through;

c) one face of the textile is coated with a thermoadhesive layer.

2. An interlining having two outer faces, the interlining comprising:

a) an outer thermoadhesive layer coating one of the outer faces of the interlining; and b) two textile layers bonded together by a continuous adhesive inner layer made of at least one cross-linkable polymer, each of the two textile layers having respective inner faces and outer faces, the outer faces constituting the outer faces of the interlining, the adhesive inner layer being obtained by a process including:

1) hot spraying the polymer onto the inner face of one of the textile layers at a temperature and for a duration so as not to heat the outer face's outer thermoadhesive layer to or above the outer thermoadhesive layer's bonding temperature, so that properties of the outer thermoadhesive layer are not affected during the hot spraying of the continuous adhesive layer onto the inner face.

3. A textile product having at least first and second layers, the textile being produced by a process of:

hot-spraying a continuous adhesive layer of at least one cross-linkable polymer onto the first layer;

immediately thereafter laminating the first layer to the second layer via the continuous adhesive layer so that the continuous adhesive layer substantially prevents bleed-through; and an outer thermoadhesive layer coating one of the outer faces of the textile.

4. The textile product of claim 3, wherein the hot-spraying step in the process by which the textile product is produced comprises:

hot-spraying the adhesive layer onto the first layer at a temperature and for a duration so as not to heat the outer thermoadhesive layer to or above the thermoadhesive layer's bonding temperature, so that the properties of the thermoadhesive layer are not affected during the hot spraying.

* * * * *